US006409357B1

(12) United States Patent
Thompson et al.

(10) Patent No.: US 6,409,357 B1
(45) Date of Patent: Jun. 25, 2002

(54) ILLUMINATED BILLFOLD, PORTFOLIO, BOOK AND THE LIKE

(76) Inventors: Roger R. Thompson; Robin A. Thompson, both of 10 River View Pl., Sea Bright, NJ (US) 07760

( * ) Notice: Subject to any disclaimer, the term of this patent is extended or adjusted under 35 U.S.C. 154(b) by 0 days.

(21) Appl. No.: 09/758,281

(22) Filed: Jan. 12, 2001

(51) Int. Cl.[7] ..... A47B 19/00

(52) U.S. Cl. ..... 362/98; 362/99; 362/155; 362/156

(58) Field of Search ..... 362/98, 99, 156, 362/253, 802, 155; 40/571, 568, 569, 904

(56) References Cited

U.S. PATENT DOCUMENTS 4,290,093 A * 9/1981 Thompson et al. ..... 362/98
4,363,081 A * 12/1982 Wilbur ..... 362/98
4,583,562 A * 4/1986 Stewart ..... 132/9
5,355,115 A * 10/1994 Goor et al. ..... 362/155
5,639,156 A * 6/1997 Broxson ..... 362/98

* cited by examiner

*Primary Examiner*—Stephen Husar
*Assistant Examiner*—Guiyoung Lee
(74) *Attorney, Agent, or Firm*—Charles I. Brodsky

(57) ABSTRACT

A page of printed information content between front and back covers is automatically illuminated when the covers are folded away from one another by a source of illumination affixed to at least one of the covers adjacent an edge surface thereof, while the other of the covers includes a notch in opposite position to overlie the source when the covers are folded closed, thereby retaining the page substantially flat—with electronic switch means serving to energize the illumination source only when the front and back covers are separated.

16 Claims, 4 Drawing Sheets

31, 33 CONTACT = SWITCH OPEN
31, 33 SEPARATE = SWITCH CLOSED

ILLUMINATED BILLFOLD, PORTFOLIO, BOOK AND THE LIKE

FIELD OF THE INVENTION

This invention relates to billfolds, portfolios, books and the like, in general, and to an improvement in the ease of their readings, in particular.

BACKGROUND OF THE INVENTION

As is well known in the restaurant industry, eating establishments range in quality from elegant 5-star restaurants to bistros oftentimes characterized by critics as nothing more than "greasy spoons"—the one serving continental delicacies and the other serving what almost amounts to "blue-plate specials". Whereas the posh establishment is typified by waiters in formal wear, the other is frequently characterized by servers dressed in jeans outfits. While the upscale restaurant may serve fine wine, the other may have available what connoisseurs would only refer to as "vinegar". While service in the more-expensive establishment may be romantic, by candlelight, the service in the others may be garish, under fluorescent lighting. On the other hand—and as will be appreciated by anyone who has had the occasion to visit both types of places—the very bright illumination which interferes with the quiet of an interlude, at the same time makes it far easier to read a menu, or wine list—whose content, many times, is written in words less pronounceable and understandable than roast chicken, fried shrimp or chopped steak. In actuality, the candle lit atmosphere of the high-end restaurant frequently makes a reading of a wine list, a menu or the presented bill at the end of the meal difficult at best, and almost impossible at worst.

SUMMARY OF THE INVENTION

As will become clear from the following description, the teachings of the present invention will be seen to be applicable not only to the billfold, menu and wine list environments of the restaurant industry, but as to those of the book, magazine and portfolio industries as well. Thus, and as will be described, the present invention will be appreciated to focus additional illumination to that which is being read, and substantially only at the time when the printed information is being reviewed. In this manner, the soft, quiet atmosphere of the dimly lit scene can be maintained, except when the printed material needs to be read.

Particularly, in accordance with the invention, a page of printed information content is to be included between the front and back covers which support it. A first source of illumination affixed to at least one of the covers adjacent to one of its edge surfaces is included, along with a notch in the other of the front and back covers opposing that source to enable closing of the page substantially flat when the covers are folded toward one another—as when closing a menu, a wine list or the billfold holding the restaurant check. At the same time, an electronic switch is included to automatically energize the source of illumination to illuminate the page of printed information content only when the front and back covers are folded away from one another—as when opening the menu, the wine list or the billfold. As will be appreciated, depending upon the design selected, the illumination may commence when the covers are opened from side-to-side, or when opened from bottom-to-top (depending upon the construction), with the shutting off of the illumination occurring when the covers are folded closed. In accomplishing this, the present invention incorporates a battery (be it a watch battery, a calculator battery or otherwise), along with a position sensor to automatically energize the source of illumination only in response to the folding away of the two covers employed.

In accordance with the embodiment of the invention utilized in a billfold, the battery may be enclosed within its back cover, where the position sensor includes cooperating parts affixed at opposing points on inside surfaces of each of the front and back covers respectively. There, the page of printed information may be included atop the inside surface of the back cover to which the source of illumination is affixed (as with the restaurant check, for example), and in which the check is removable from the inside surface once it has been paid, for reuse of the billfold by the proprietor. In such instance, an overhang may be provided to the source of illumination—typically a small light bulb—to direct the light downwardly so as to facilitate its reading. A coverlet may also be provided to hold the check in place until removed.

For reading a menu or wine list, on the other hand—where descriptions and prices are printed on both left and right hand sides of the page—, a second source of illumination may be provided at the bottom of the inside surface of the front cover, so that one source illuminates downwardly while the other source illuminates upwardly. In effectuating this, according to the invention, however, a notch is provided opposite the one or both illumination sources so as to enable the closing of the page of written content substantially flat when folding the covers toward one another. Thus, and as will be described below, where two sources of illumination are employed, the notch in the front cover would overlie the illumination source on the back cover when they are folded together, as would the notch in the back cover overlie the illumination source on the front cover to give the ultimately flat appearance when closed. Further, in this respect, as long as the notch in the one overlies the source of illumination affixed to the other, such flat look results whether the folding be from side-to-side (i.e., left-to-right) or top-to-bottom, or vice versa, in closing.

In carrying out these functions, a preferred embodiment of the invention includes a battery enclosed within one or both of the front and back covers, electrical interconnections between the source(s) of illumination and the battery, and an electrical switch in the nature of a position sensor to automatically energize either or both sources depending upon the construction, essentially only in response to the folding away of the front and back covers. Such position sensor may, as will be readily appreciated, include cooperating parts affixed at opposing points on the inside surfaces of each of the front and back covers, located such that upon the folding of the covers together, not only does (do) the notch(es) overlie the source(s) of illumination, but orient the cooperating parts of the sensor to touch and thereby disconnect the battery from the illumination source(s). Conversely, and as will be seen, folding away the covers separate the cooperating parts of the position sensor in connecting the battery to the source(s) of illumination in providing the extra lighting then being offered.

Where the page of written content constitutes printed information in a book, a magazine, a portfolio, a menu or wine list, for example, the embodiment of the invention utilizing sources of illumination on inside surfaces of both the front and back covers would obviously be more desirable. Where the teachings of the invention are to be employed in a billfold housing a restaurant check, on the other hand, only a single source of illumination might be required, on that inside surface where the check rests once laid down—usually on the right hand inside surface of the back cover. In such version of the invention, a coverlet may be included, at a bottom edge of the inside surface of the back cover, to hold the check in place until removal. In this version of the invention—as well as that version wherein a second source of illumination is employed—overhangs may additionally be used to direct the illumination towards the printed content, as directing the illumination downwardly from a source affixed at a top edge of the back cover, and upwardly from an illumination source affixed at a bottom edge of the front cover. In either configuration, as noted above, the notch continues to be cut into the adjacent cover so as to overlie the illumination source when the front and back covers are folded closed, in continuing to maintain the flat appearance of the billfold, portfolio, book and the like. And, whereas the battery employed may be housed in the preferred embodiment set out in the back cover of the described configuration, it will be apparent that being as small as a watch battery or calculator battery, it may be included instead within the front cover of the combination, or in both front and back covers where two sources of illumination are employed, if so desired in that type of manufacture.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1A:
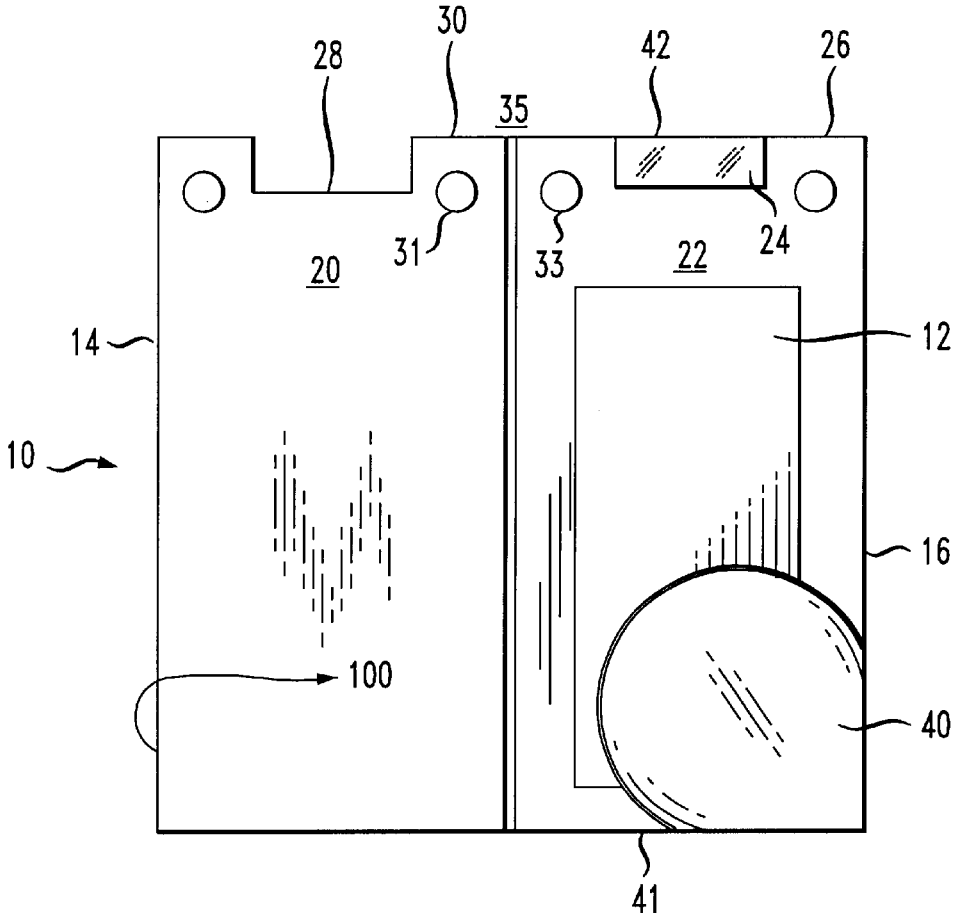
FIGS. 1A and 1B are illustrations of a first embodiment of the invention utilizing a single source of illumination for a billfold having its front and back covers folded open.
Figure 1B:
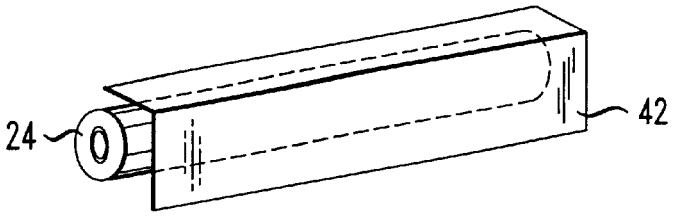

In FIG. 1A, an open billfold 10 for holding a removable restaurant check 12 (for example) includes a front cover 14, a back cover 16 and inside front and back surfaces 20, 22, respectively. A source of illumination 24 is affixed adjacent a top edge 26 of the back cover 16, opposite a notch 28 at a top edge 30 of the front cover 20 dimensioned to overlie the source of illumination 24 when laid flat atop it. Folding the front cover 14 over the back cover 16 in the direction of the arrow 100 thus orients the notch 28 over the illumination source 24—and at the same time, brings into contact cooperating parts 31, 33 of a position sensor 35; and, in so doing, breaks an electrical connection which exists when the cooperating parts 31, 33 are folded away and separated, as illustrated in FIG. 1. A coverlet 40 may be included at a bottom edge 41 of the inside surface 22 of back cover 16, to hold the restaurant check 12 in place until removal. An overhang 42 may overlie the illumination source 24 for directing the light downwardly towards the check 12 once the illumination source 24 is energized (FIG. 1B), and also fits within the notch 28.

Figure 2A:
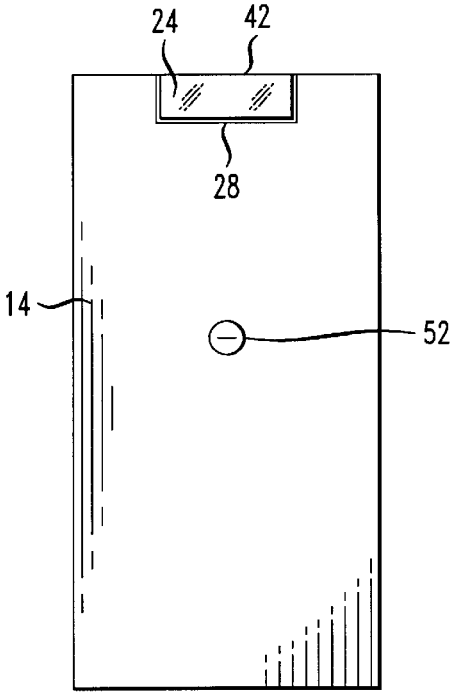
FIGS. 2A and 2B are front and rear views, respectively, of the billfold of FIG. 1A with its covers folded closed.
Figure 2B:
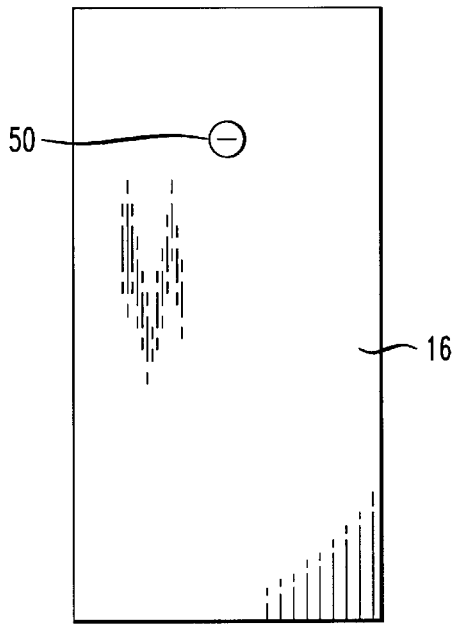
Figure 7:
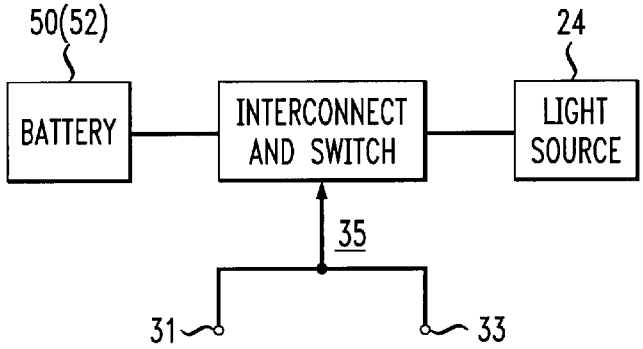
FIG. 7 is a simplified electrical block diagram helpful in an understanding of the energization of the source(s) of illumination included within the embodiments of FIGS. 1, 3 and 5.

FIG. 2B illustrates an additional battery within the back cover 16 for energizing the source 24, although such battery (shown as 50) may be incorporated in the front cover 14 as an alternative (as at 52 in FIG. 2A). As the block diagram of FIG. 7 illustrates, folding the covers 14, 16 away and open breaks the electrical connection between the contact parts 31, 33 of the position sensor 35, to energize the source 24 in illuminating the restaurant check 12. As FIG. 7 also shows, folding the covers 14, 16 for the contact parts 31, 33 to touch makes the electrical connection to de-energize the source 24 from the battery. FIG. 2A illustrates the notch 28 in the front cover 14 overlying the illumination source 24 at the back cover 16 in allowing the illumination source 24 to extend through the notch 28 as the billfold 10 sits closed in holding the restaurant check 12 substantially flat.

Figure 3:
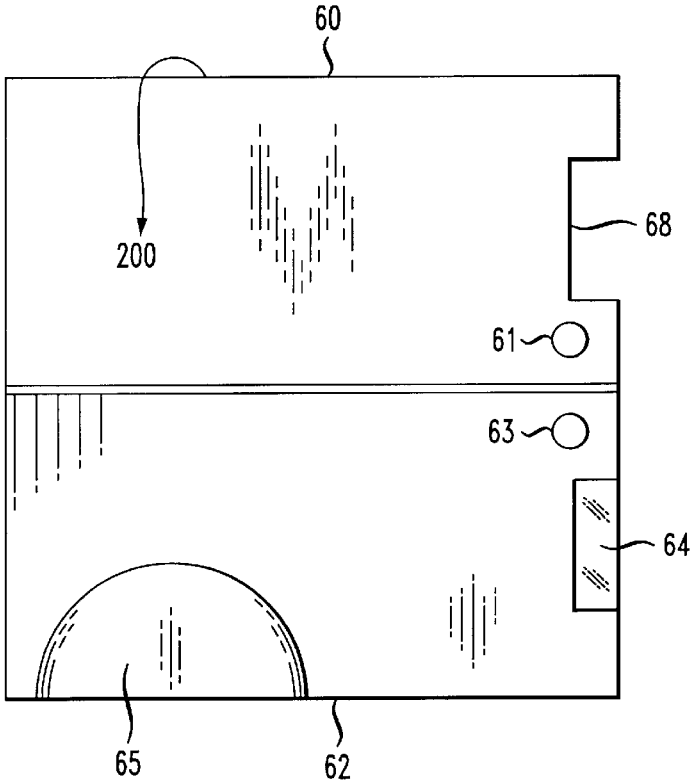
FIG. 3 is an illustration of a second embodiment for a billfold which opens from bottom-to-top, instead of from side-to-side as with the view of FIG. 1, again with its covers folded open.
Figure 4A:
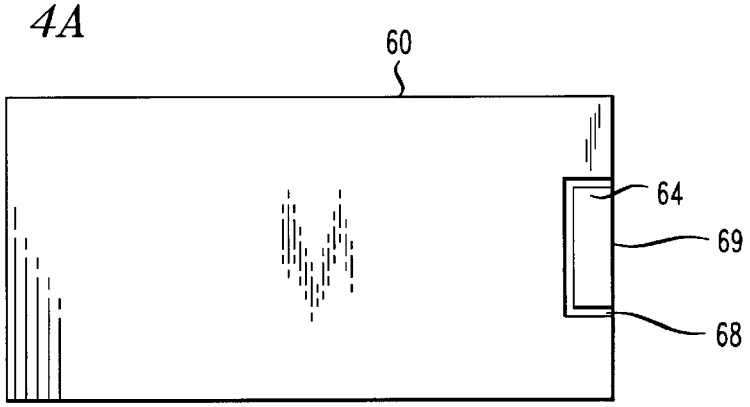
FIGS. 4A and 4B are front and rear views, respectively, of the billfold of FIG. 3 with its covers folded closed.
Figure 4B:
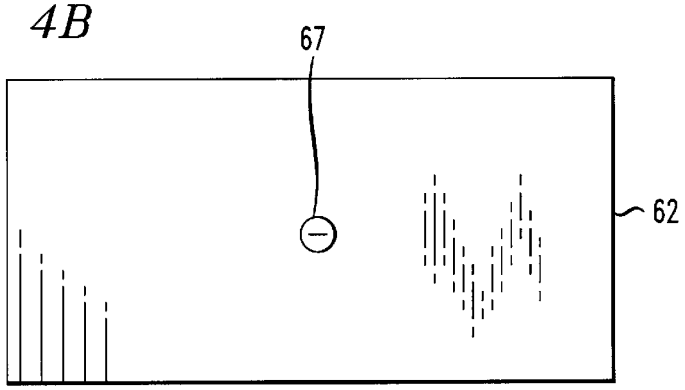

Whereas the configuration of FIGS. 1A & 1B and 2A & 2B illustrate a construction where the illumination source 24 and the notch 28 are positioned at the top edges 26 and 30 of the covers 16 and 14, respectively, the configurations of FIGS. 3 and 4A & 4B illustrate an arrangement where the source of illumination and the notch appear at the side edges of the covers instead. Thus, in FIG. 3, the top cover 60 closes over the bottom cover 62 by folding in the direction of the arrow 200 in bringing the cooperating parts 61, 63 together, in de-energizing the illumination source 64, continuing to fit within the notch 68 when folded closed. Folding the cover 60 away from the cover 62, on the other hand, opens the switch in allowing the source of illumination to be energized. The coverlet for the restaurant check is shown at 65. The battery for the source of illumination 64 is shown at 67 in the rear view of FIG. 4B, while the light director is illustrated as 69 in the front view of FIG. 4A.

Figure 5:
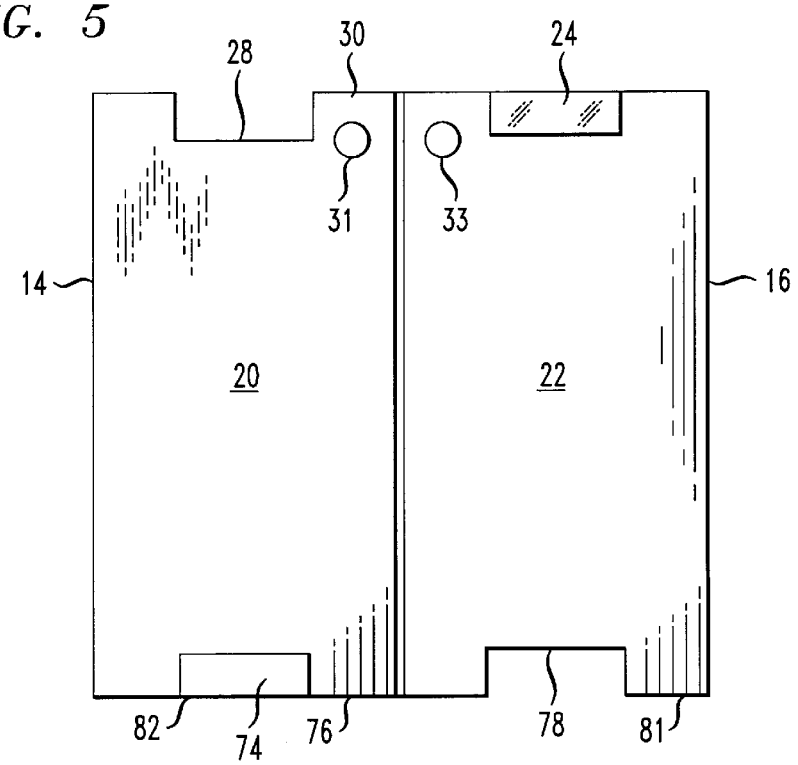
FIG. 5 is an illustration of a third embodiment of the invention for a book, magazine, portfolio, menu, wine list and the like employing two sources of illumination, with front and back covers folded open for a reading of their printed information content.
Figure 6A:
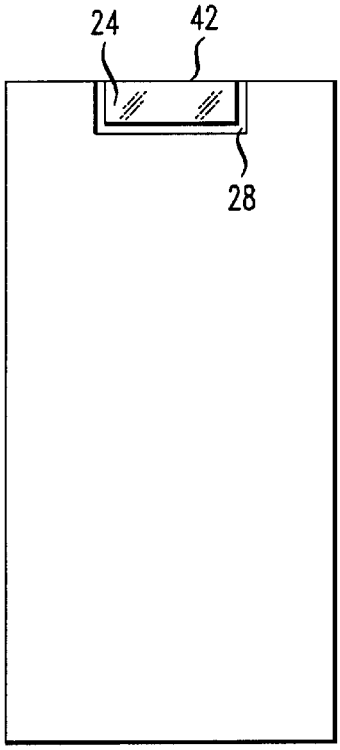
FIGS. 6A and 6B are front and rear views, respectively, of the book, magazine, portfolio, etc. of FIG. 5 with the front and back covers folded closed.
Figure 6B:
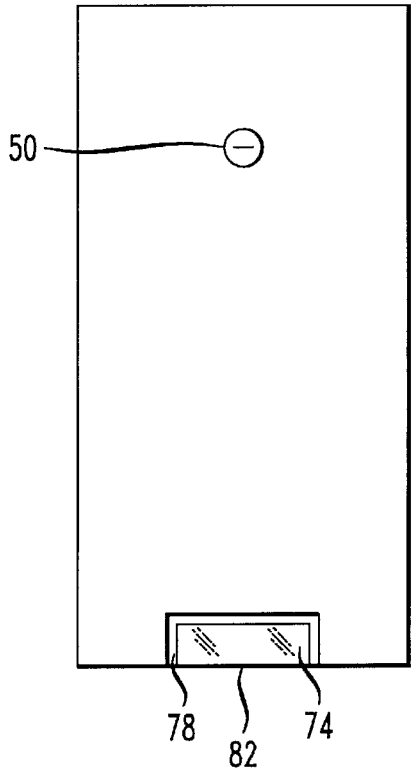

When having a book, magazine or portfolio to be illuminated on both left and right hand sides—or as with a menu or wine list, for example—a second source of illumination 74 can be had, affixed at a bottom edge 76 of the inside surface 20 of front cover 14 in FIG. 5, with its own deflector 82 to direct its illumination upwardly, while a similar notch 78 is formed at a bottom edge 81 on the inside surface 22 of the back cover 16. As with the notch 28, the second notch 78 is configured to overlie the second illumination source 74 in allowing pages of printed information content on both left and right hand sides to lie substantially flat once again, when the two covers 14, 16 are folded toward one another. The cooperating contacts 31, 33 continue, as before, as position sensors in controlling the energization of the two sources of illumination 24, 74. In such use, as will be evident, the coverlet 40 of FIG. 1 is not required.

While there have been described what are considered to be preferred embodiments of the present invention, it will be readily appreciated by those skilled in the art that modifications can be made without departing from the scope of the teachings herein. Thus, for example, whereas one method of disabling the source(s) of illumination from the energizing battery has been disclosed, other manners of so doing upon the unfolding of the covers of the billfold, book, magazine, portfolio, and the like will be understood to be possible—as long as the end result is the disabling of the illumination source when the covers are closed, and energizing it when the covers are opened. For at least such reason, therefore, resort should be had to the claims appended hereto for a true understanding of the scope of the invention.

We claim:

1. The combination comprising:

a page of printed information content between front and back covers;

a first source of illumination affixed to at least one of said front and back covers adjacent an edge surface thereof;

a notch in the other of said front and back covers opposite said source of illumination, said notch being dimensioned to overlie said source of illumination and to allow said source of illumination to extend therethrough when closing said page substantially flat folding said covers atop one another;

and electronic switch means connected to said source of illumination for energizing said source to illuminate only when said front and back covers are folded away from one another; and wherein said electronic switch means includes a battery and a position sensor in direct connection to automatically energize said source only in response to the folding away from each other of said front and back covers, wherein said battery is enclosed within one of said front and back covers, and wherein said position sensor includes cooperating parts affixed at opposing points on inside surfaces of each of said front and back covers, respectively.

2. The combination of claim 1 wherein said notch closes said page of printed information content substantially flat when folding said covers from side-to-side toward one another, and wherein said electronic switch means energizes said source to illuminate only when said front and back covers are folded from side-to-side away from one another.

3. The combination of claim 2 wherein said notch closes said page of printed information content substantially flat when folding said covers from top-to-bottom toward one another, and wherein said electronic switch means energizes said source to illuminate only when said front and back covers are folded from bottom-to-top away from one another.

4. The combination of claim 1 wherein said page of printed information content appears atop said inside surface of said back cover, and wherein said source of illumination is affixed to said back cover.

5. The combination of claim 4 wherein said page of printed information content is removable from atop said inside surface of said back cover.

6. The combination of claim 5 wherein said page of printed information content is a restaurant check inside a billfold having front and back covers.

7. The combination of claim 6 wherein said billfold includes said source of illumination affixed at a top edge of said back cover.

8. The combination of claim 7 wherein said billfold also includes an overhang to said source of illumination for directing illumination downwardly therefrom, said overhang being of size to fit within the dimension of said notch when said covers are folded atop one another.

9. The combination of claim 7 wherein said billfold also includes a coverlet at a bottom edge of said inside surface of said back cover for holding said restaurant check in place until removal.

10. The combination of claim 7 wherein said notch is included at a top edge of said front cover for overlying said source of illumination when said front and back covers are folded toward one another.

11. The combination of claim 10 wherein said cooperating parts of said position sensor are affixed on said inside surface of said back cover adjacent to said source of illumination and on said inside surface of said front cover adjacent to said notch, respectively.

12. The combination of claim 1 wherein said page of printed information content appears atop said inside surface of each of said front and back covers, wherein a second source of illumination is affixed to said other of said front and back covers adjacent an opposing edge surface thereof, and wherein said notch is included in each of said front and back covers opposite the source of illumination affixed to said facing back and front cover, respectively.

13. The combination of claim 12 wherein said battery is enclosed within at least one of said front and back covers, wherein said position sensor includes cooperating parts affixed to opposing points on inside surfaces of each of said front and back covers respectively, and wherein said electronic switch means automatically energizes both said sources of illumination together in response to the folding away of said front and back covers.

14. The combination of claim 13 wherein said page of printed information content are the pages of a book between front and back covers, and wherein said sources of illumination illuminate upwardly from the bottom of one inside surface and downwardly from the top of said other inside surface, respectively.

15. The combination comprising:

an openable cover having left and right hand inside surfaces;

a source of illumination affixed to one of said left and right hand inside surfaces adjacent a top edge thereof;

a notch in said other of said left and right hand inside surfaces adjacent a top edge thereof;

a first electrical sensor positioned about said source of illumination;

a second electrical sensor positioned about said notch;

a battery;

and direct electrical interconnections between said battery, said source of illumination, and said first and second sensors;

with said notch being dimensioned, and said first and second sensors being positioned, such that upon folding of said cover substantially flat, said notch overlies said source of illumination in allowing said source of illumination to extend therethrough and said second electrical sensor contacts said first electrical sensor;

and with said electrical interconnections being such as to connect said battery to said source of illumination only when separating said second sensor from said first sensor.

16. The combination of claim 15, with said electrical interconnections being such as to disconnect said battery from said source of illumination when contacting said second sensor to said first sensor.

* * * * *